US005546714A

United States Patent [19]

Kenkel

[11] Patent Number: 5,546,714

[45] Date of Patent: Aug. 20, 1996

[54] GLAZING SEAL AND DOOR FRAME

[75] Inventor: Terry Kenkel, Des Moines, Iowa

[73] Assignee: EMCO Enterprises, Inc., Des Moines, Iowa

[21] Appl. No.: 368,844

[22] Filed: Jan. 5, 1995

[51] Int. Cl.[6] ..... E06B 3/54

[52] U.S. Cl. ..... 52/204.5; 52/204.597; 52/204.62; 52/204.67; 52/204.705; 52/204.71; 52/455; 49/466; 49/501

[58] Field of Search ..... 52/204.5, 204.71, 52/204.597, 204.62, 204.67, 204.68, 204.7, 204.705, 204.65, 455, 457; 49/466, 498.1, 501

[56] References Cited

U.S. PATENT DOCUMENTS

| | | | |
|---|---|---|---|
| 1,027,675 | 5/1912 | Viberg | 49/466 X |
| 2,664,602 | 1/1954 | Bright | 49/498.1 X |
| 2,953,824 | 9/1960 | Minick | 49/498.1 X |
| 3,504,468 | 4/1970 | Martin | 52/204.597 X |
| 4,949,524 | 8/1990 | Martin et al. | 49/498.1 X |
| 4,959,081 | 9/1990 | Mathellier | 49/498.1 X |

*Primary Examiner*—Carl D. Friedman
*Assistant Examiner*—Christopher Todd Kent
*Attorney, Agent, or Firm*—Zarley, McKee, Thomte, Voorhees, & Sease

[57] ABSTRACT

A glazing seal is used in combination with a rectangular door frame and a rectangular window frame. The door frame includes a window opening and the window frame is fitted within the window opening. The window frame surrounds a sheet of glass having a perimetric edge. The sealing member has a first portion extending around the perimetric edge of the glass and sealingly engaging the edge of the glass and the window frame. The sealing member also has a second portion thereof fitted between the window frame and the door frame to provide a substantially airtight seal there between.

8 Claims, 3 Drawing Sheets

GLAZING SEAL AND DOOR FRAME

BACKGROUND OF THE INVENTION

This invention relates to a window glazing seal.

Glazing seals are commonly used around the edges of glass which is fitted within a window frame. The seal provides the function of providing an airtight seal between the glass and the window frame.

When the window frame is placed within a door frame, as would be the case with an aluminum storm door, the prior art presently utilizes a second seal between the window frame and the door frame.

Therefore, a primary object of the present invention is the provision of an improved glazing seal.

A further object of the present invention is the provision of a glazing seal that includes a boot for surrounding the glass and protecting the glass from being chipped or impacted by the aluminum window frame in which it is sealed.

A further object of the present invention is the provision of an improved window seal which has a first portion forming a seal between the glass and the window frame and which includes a second portion providing a seal between the window frame and a door frame of an aluminum storm door.

A further object of the present invention is the provision of an improved window seal that reduces the parts necessary for providing a seal between glass and a window frame on the one hand and the window frame and the door frame on the other hand.

A further object of the present invention is the provision of an improved window seal which creates one continuous seal from the glass to the door frame and also creates a continuous seal around the window frame.

A further object of the present invention is the provision of an improved window seal which is economical to manufacture, durable in use, and efficient in operation.

SUMMARY OF THE INVENTION

The foregoing objects may be achieved by a glazing seal adapted for insertion between the edge of a glass sheet member and an elongated frame channel in a frame member. The frame channel includes a cross-sectional configuration for receiving the edge of the sheet member.

The glazing seal of the present invention comprises an elongated body made of flexible elastomeric material. The body in cross-section includes a sealing channel or boot with a bottom wall, opposite side walls, and an open top. The bottom wall and the side walls have interior surfaces adapted to matingly receive, and seal against, the edge of the glass sheet member.

The bottom wall and the opposite side walls of the sealing channel or boot also have outer surfaces which combine to provide an exterior profile sized to matingly fit within the frame channel when the edge of the glass is matingly received by the interior surfaces of the sealing channel or boot.

The body also includes an elongated tube attached to and extending along the exterior surface of one of the side walls of the sealing channel.

The glazing seal of the present invention may be used in combination with a door frame having a window opening. A window frame is fitted within the window opening and the window frame surrounds a sheet of glass having a perimetric edge. The sealing member of the present invention includes a first portion extending around the perimetric edges of the sheet of glass and sealingly engaging the edge of the glass and the window frame to provide a substantially airtight seal there between. The sealing member includes a second portion fitted between the window frame and the door frame to provide a substantially airtight seal there between whereby the sealing member provides a unitary substantially airtight seal between the glass and the window frame, the window frame and the door frame, and the glass and the door frame.

DETAILED DESCRIPTION OF THE PREFERRED EMBODIMENT

Figure 1:
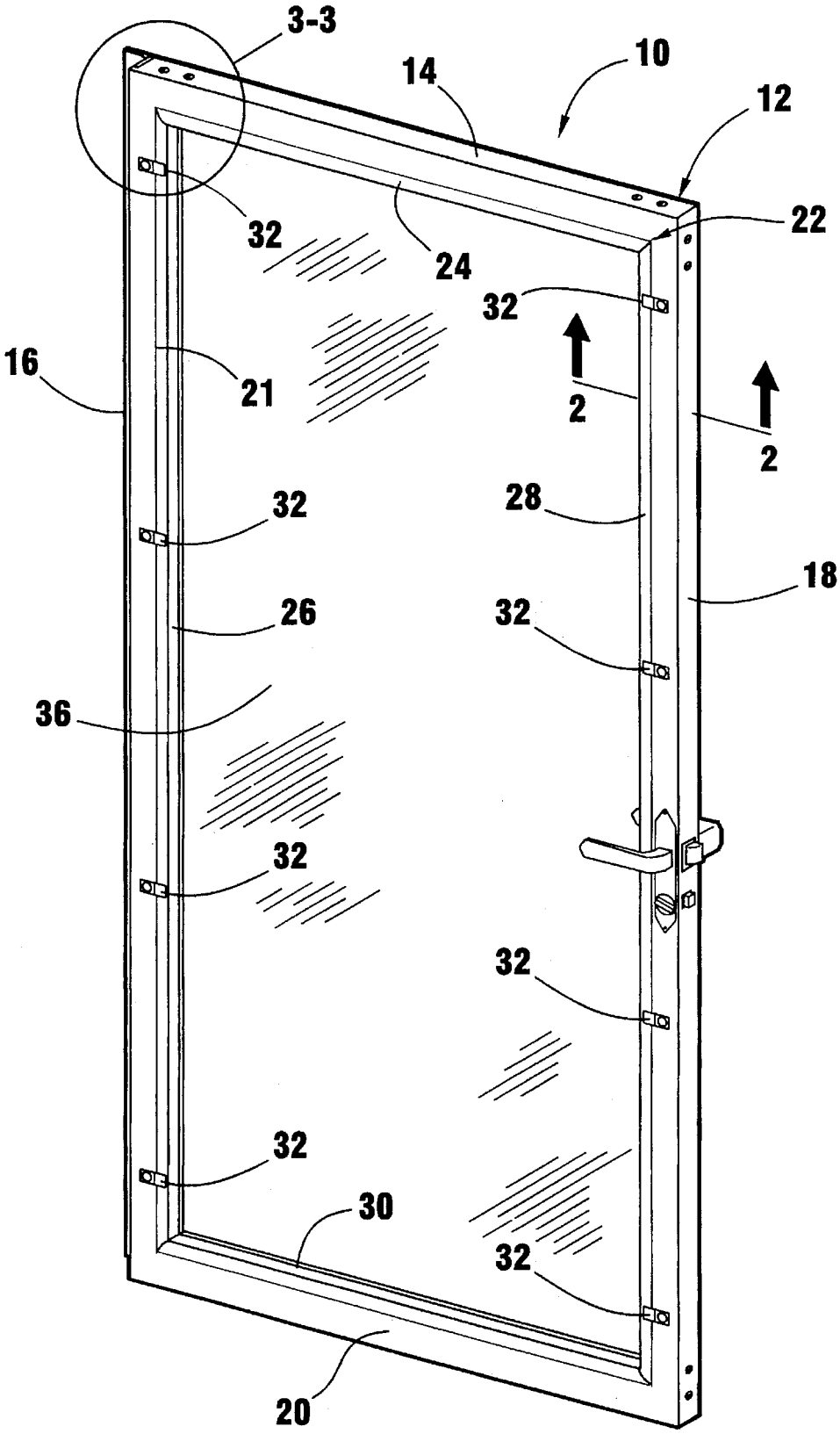
FIG. 1 is a perspective view of atypical aluminum storm door utilizing the present invention.

Referring to FIG. 1 a storm door 10 includes a door frame 12 which is comprised of a top frame member 14, side frame members 16, 18, and a bottom frame member 20 which combine to form an enclosed rectangular opening 21.

Fitted within opening 21 is a window frame 22 which is comprised of a top window frame member 24, side frame members 26, 28, and bottom member 30. The frame members 24, 26, 28, 30 surround a rectangular sheet of glass 36. The rectangular window frame 22 is retentively held within the opening 21 of door frame 12 by means of attachment clips 32 which are attached to the door frame 12 by means of screws 34 and which also engage the window frame 22 to hold it in place.

Figure 2:
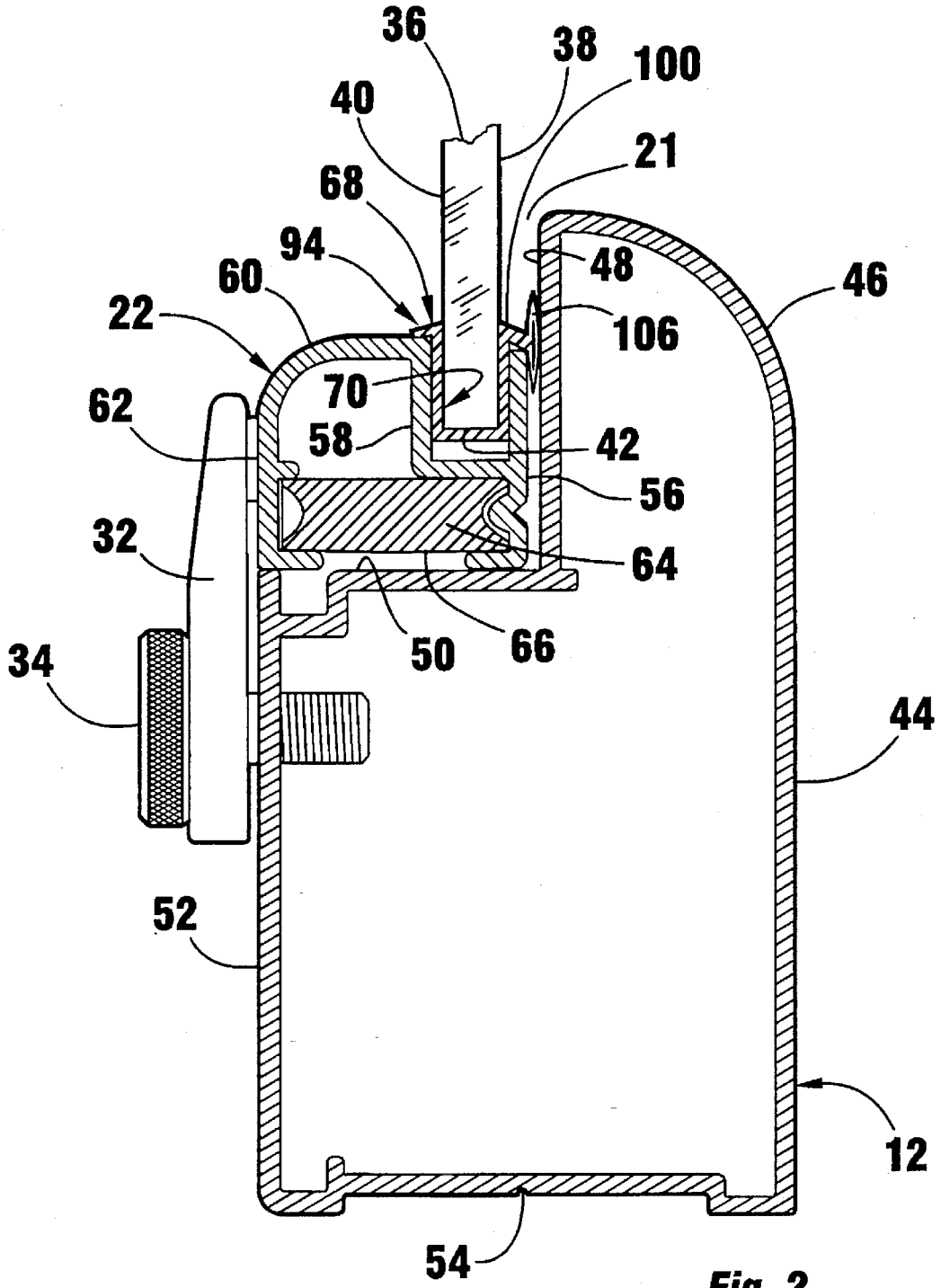
FIG. 2 is an enlarged sectional view taken along line 2—2 of FIG. 1.
Figure 3:
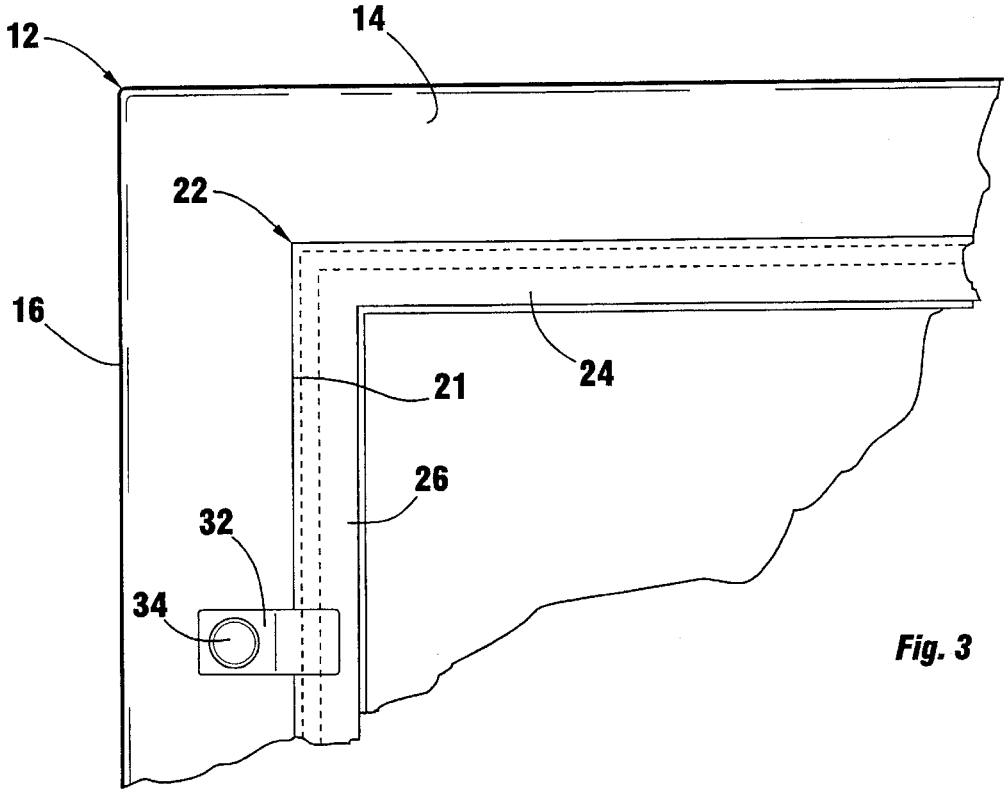
FIG. 3 is an enlarged detailed view taken along line 33 of FIG. 1.

Referring to FIG. 2, glass 36 includes an outer face 38 and an inner face 40, and a perimetric edge 42.

The door frame 12 in cross-section includes a vertical outer surface 44, a curved upper surface 46, a vertical rabbet surface 48, a horizontal rabbet surface 50, an inner vertical surface 52, and an edge surface 54. The window frame 22 fits within the rabbet formed by vertical rabbet surface 48 and horizontal rabbet surface 50.

In cross-section the window frame includes a vertical front surface 56, a U-shaped frame channel 58, a curved surface 60, a vertical inner surface 62, and a spacer strip 64 which extends along and forms an outer edged surface 66 for window frame 22.

Figure 4:
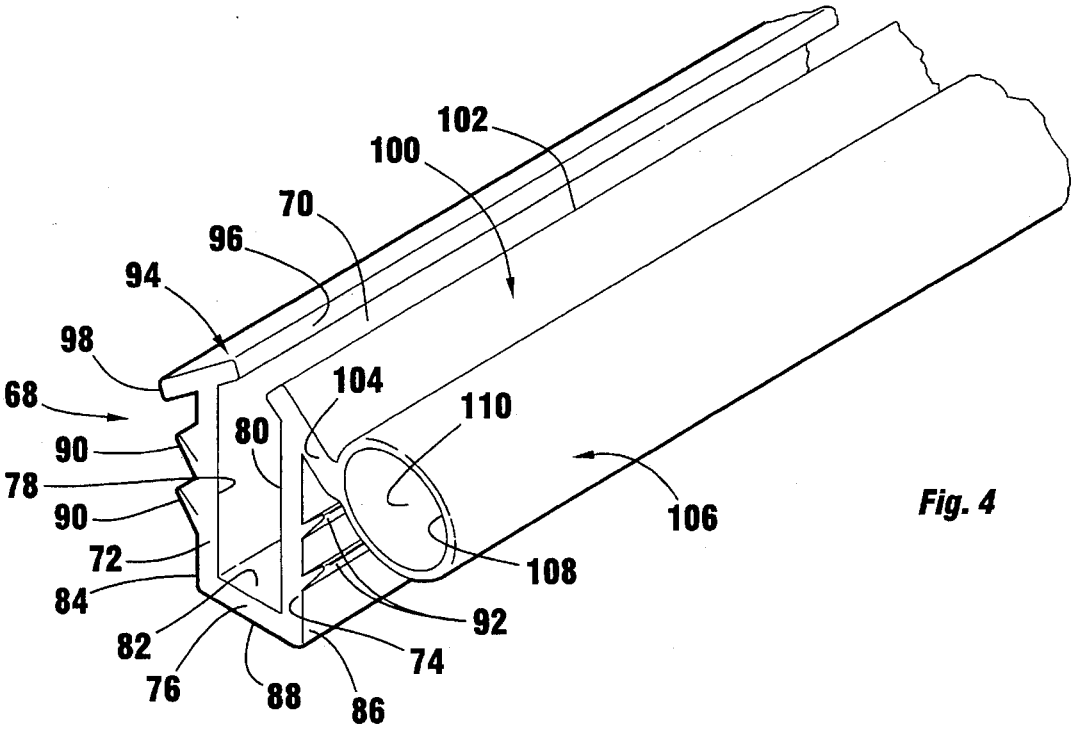
FIG. 4 is an enlarged pictorial view showing a section of the elongated seal of the present invention.

The glazing seal of the present invention is shown in FIG. 4, and is designated by the numeral 68. Seal 68 includes a U-shaped channel 70 having opposite side walls 72, 74, and an edge wall 76. The interior surface of the U-shaped channel 70 is provided by the inner surface 78 of wall 72, the inner surface 80 of wall 74, and the inner surface 82 of the wall 76. The outer surfaces of walls 72, 74, 76, are designated by the numerals 84, 86, 88, respectively. On the outer surfaces of 84, 86, of walls 72, 74, are ribs 90, 92, respectively. The upper edge of wall 72 is provided with a canted flap 94 having an inner edge 96 and an outer edge 98. the upper edge of wall 74 is provided with a canted flap 100 having an inner edge 102 and an outer edge 104. Attached to the outer edge 104 is an elongated tube 106 comprised of a tube wall 108 forming an elongated cylindrical tube opening 110. The entire sealing member 68 shown in FIG. 4 is of integral construction and is formed of a flexible elastomeric material such as rubber or other conventionally used elastomeric sealing materials.

Sealing member 68 is initially placed around the outer perimetric edge 42 of the glass 36 in the manner shown in FIG. 2, with the edge 42 of the glass 36 being frictionally fitted within the U-shaped channel 70 of the sealing member 68. Next the U-shaped channel 70 is matingly inserted within the U-shaped frame channel 58 of the window frame 22. This compresses the U-shaped channel 70 of the sealing member 68 so as to provide a substantially airtight seal between the window 36 and the window frame 12.

The canted upper flaps 94, 100, of sealing member 68 engage the upper edges of the U-shaped frame channel 58 so as to provide a tight seal there between and so as to prevent moisture from entering between the sealing member 68 and the interior surfaces of the U-shaped frame channel 58. The interior edges 96, 102, of the canted flaps 94, 100, respectively engage the glass to prevent moisture from entering the space between the sealing members 68 and the glass 36.

When the window frame 22 is inserted into the rabbet formed by the vertical and horizontal rabbet surfaces 48, 50, of door frame 12, the flexible tube 106 is pinched between the window frame 22 and the vertical rabbet surface 48 of door frame 12. This pinching action causes the tube 106 to collapse into the configuration shown in FIG. 2, thereby forming a seal between the door frame 12 and the window frame 22.

Several advantageous results are obtained with the above configuration. The U-shaped channel 70 (sometimes referred to as a glazing boot) protects the edges of the glass from being chipped or impacted by the aluminum window frame 22. The boot 70 also provides a gasket and seal between the window frame 22 and the glass to prevent both water and air infiltration. The tube or bulb 106 forms a gasket between the window unit and the door frame to prevent both water and air infiltration.

The typical prior art window unit utilizes a glazing seal for sealing the glass within the window frame and a separate seal for sealing the window frame to the door frame. The present invention combines these two items to reduce the number of parts in the manufacturing process. Also the seal of the present invention creates one continuous seal from the glass to the door frame and at the same time creates a continuous seal around the window frame.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. In combination:

a rectangular door frame forming a window opening;

a sheet of glass having a perimetric edge;

a window frame fitted within said window opening, said window frame overlapping the edge and both sides adjacent the perimeter of the glass sheet;

sealing member having a first portion extending around said perimeter of the glass sheet and sealingly engaging said edge of said glass and said window frame to provide a substantially airtight seal there between;

said sealing member having a second portion unitary with said first portion fitted between said window frame and said door frame to provide a substantially airtight seal there between, whereby said sealing member provides a unitary substantially airtight seal between said glass and said window frame, said window frame and said door frame, and said glass and said door frame.

2. A combination according to claim 1 wherein said second portion of said sealing member comprises an elongated tube having collapsible walls.

3. A combination according to claim 2 wherein said first portion of said sealing member comprises a U-shaped channel matingly receiving said edge of said glass.

4. A glazing seal for insertion between the edge of a glass sheet member and an elongated frame channel in a frame member, said frame channel having a cross sectional configuration for receiving said edge of said sheet member; said glazing seal comprising:

an elongated body made of flexible elastomeric material;

said body having in cross-section a sealing channel with a bottom wall, opposite side walls, and an open top, said bottom wall and said side walls having interior surfaces adapted to matingly receive said edge of said glass sheet member;

said bottom wall and said opposite side walls having outer surfaces which combine to provide an exterior profile sized to matingly fit within said frame channel when said edge of said glass is matingly received by said interior surfaces, wherein said outer surfaces of said opposite side walls include ribs thereon for frictionally engaging said frame channel of said frame member said body having an elongated tube attached to and extending along said outer surface of one of said side walls of said sealing channel;

said tube including tube walls surrounding a hollow cylindrical opening extending longitudinally there through, said tube walls being collapsible into face to face engagement so as to eliminate said hollow cylindrical opening there between.

5. A glazing seal according to claim 4 wherein said glazing seal is of an integral construction.

6. A glazing seal according to claim 4 wherein said opposite side walls each have upper edges, an elongated canted flap extending along each of said upper edges, said canted flap having inward edges adapted to extend partially over the frame channel so as to provide further sealing engagement of said glass sheet member.

7. A glazing seal according to claim 6 wherein one of said canted flaps includes an outer edge adapted to sealingly engage said elongated frame channel.

8. A glazing seal according to claim 6 wherein said elongated tube is integral with the other of said canted flaps.

* * * * *